US005184551A

United States Patent [19]

Wallmann et al.

[11] Patent Number: 5,184,551

[45] Date of Patent: Feb. 9, 1993

[54] PRINTING PRESS

[75] Inventors: Wilfried Wallmann, Lengerich; Günter Rogge; Wolfgang Knapheide, both of Lienen, all of Fed. Rep. of Germany

[73] Assignee: Windmöller & Hölscher, Lengerich, Fed. Rep. of Germany

[21] Appl. No.: 699,659

[22] Filed: May 14, 1991

[30] Foreign Application Priority Data

May 28, 1990 [DE] Fed. Rep. of Germany ..... 4017159

[51] Int. Cl.[5] ..... B41F 5/04

[52] U.S. Cl. ..... 101/219; 101/247

[58] Field of Search ..... 101/139, 140, 136, 137, 101/141, 143-145, 177, 178, 180, 181-185, 189, 216-219, 221, 228, 231, 232-234, 247

[56] References Cited

U.S. PATENT DOCUMENTS

| | | | |
|---|---|---|---|
| 2,425,167 | 8/1947 | Whitehead | 101/221 |
| 2,444,547 | 7/1948 | Whitehead | 101/221 |
| 3,800,698 | 4/1974 | Kist eet al. | 101/137 |
| 4,369,705 | 1/1983 | Gelinas | 101/177 |
| 4,696,229 | 9/1987 | Bezler et al. | 101/177 |
| 4,919,046 | 4/1990 | Kakko-Chiloff | 101/177 |

FOREIGN PATENT DOCUMENTS

| | | | |
|---|---|---|---|
| 61618 | 10/1982 | European Pat. Off. | 101/144 |

*Primary Examiner*—Clifford D. Crowder
*Assistant Examiner*—J. R. Keating
*Attorney, Agent, or Firm*—Keck, Mahin & Cate

[57] ABSTRACT

A printing press comprising at least one printing stand, in which an impression cylinder, two printing cylinders, which are movable into engagement with the impression cylinder, and inking rollers associated with said plate cylinders, are rotatably mounted, and a main drive, which is operatively connected to the impression cylinder, wherein the impression cylinder, the plate cylinders and the inking rollers comprise stub shafts, to which gears are secured, which are adapted to be in mesh for synchronous rotation during a printing operation. In order to accomplish the object to provide such a printing press in which a loss of production in case of a change-over from one printing job to another can almost entirely be avoided the invention resides in that each plate cylinder is operatively connected to the main drive for the associated impression cylinder by a clutch for uncoupling the plate cylinder from said main drive and is operatively connected to a controllable servomotor for accelerating the plate cylinder to rotate at the same peripheral velocity as the impression cylinder (synchronous velocity), and each plate cylinder when it has been accelerated to the synchronous velocity is adapted to be coupled to the main drive for the impression cylinder.

5 Claims, 3 Drawing Sheets

PRINTING PRESS

BACKGROUND OF THE INVENTION

1. Field of the Invention

This invention relates to a printing press, preferably a flexographic printing press, comprising at least one printing stand, in which an impression cylinder, two printing cylinders, which are movable into engagement with the impression cylinder, and inking rollers associated with said plate cylinders, are rotatably mounted, and a main drive, which is operatively connected to the impression cylinder, wherein the impression cylinder, the plate cylinders and the inking rollers comprise stub shafts, to which gears are secured, which are adapted to be in mesh for synchronous rotation during a printing operation.

2. Description of the Prior Art

Printing presses of that kind are known in various embodiments. For a movement to impression throw on and impression throw off positions and for a performance of large strokes for a change of the plate cylinder the plate cylinders are rotatably mounted in carriages, which are slidably mounted in the printing stand, and the inking rollers of the inking mechanisms are also rotatably mounted in carriages, which are guided on the plate cylinder carriages and are displaceable parallel to themselves.

A printing press of that kind can be set up for a given printing job in that the prepared plate cylinder intended to be used for that job or—for multicolor printing—the plate cylinders for printing in usually four or six different colors is or are installed. The change-over for a different printing job will involve a considerable downtime, which gives rise to high costs particularly in heavy-duty printing presses owing to the loss of production.

From Published German Application 34 32 572 it is known in a printing press to accelerate the impression cylinder, the plate cylinder and the inking roller by servomotors to a synchronous velocity, which is maintained by the servomotors during the printing operation.

SUMMARY OF THE INVENTION

It is an object of the invention to provide a printing press which is of the kind described first hereinbefore and in which a loss of production in case of a change-over from one printing job to another can almost entirely be avoided so that the utilization factor of the printing press can considerably be increased.

In the printing press of the kind described first hereinbefore that object is accomplished in accordance with the invention in that each plate cylinder is opeatively connected to the main drive for the associated impression cylinder by a clutch for uncoupling the plate cylinder from said main drive and is operatively connected to a controllable servomotor for accelerating the plate cylinder to rotate at the same peripheral velocity as the impression cylinder (synchronous velocity), and each plate cylinder when it has been accelerated to the synchronous velocity is adapted to be coupled to the main drive for the impression cylinder. In the operation of the printing press in accordance with the invention the printing operation for a new printing job can be initiated immediately after the previous printing job, which may have been of an entirely different kind, has been completed and there will be no need in such case for a change-over requiring a shutdown of the entire printing press. When a printing job has been completed in the operation of the printing press in accordance with the invention the web which is moving through the printing press at an unreduced velocity can be printed in a different operation for a different printing job without a production of waste paper in appreciable amounts between the two printing jobs.

In the simplest case the printing press in accordance with the invention may comprise a printing stand, in which an impression cylinder, two plate cylinders, which are movable into and out of engagement with the impression cylinder, and inking rollers associated with said plate cylinders, are rotatably mounted. In the operation of such a printing press the change-over from one printing job to another for printing in one color can be performed without a need for a shutdown involving a stoppage of the printing machine. While the impression cylinder is running and the web to be printed is moving in contact with the impression cylinder during the performance of the current printing job the plate cylinder which has been prepared for use in the next following printing job is installed in the printing stand and connected to the bearings and by means fo the associated plate cylinder carriage is moved to such a position that the gear of said plate cylinder can be caused to mesh with the associated gear of the impression cylinder. Before the current printing job has been completed, the plate cylinder intended to be used for the next printing job is accelerated by the servomotor to rotate at the synchronous velocity, which equals the velocity of the web to be printed and the peripheral velocity of the impression cylinder. In response to an instruction for a change-over to another printing job, the plate cylinder used for the preceding printing job is disengaged from the impression cylinder, the drive gear of the new plate cylinder is moved into engagement with the impression cylinder and the gear of the new plate cylinder is caused to mesh with the gear of the impression cylinder. Even before the current printing job has been completed can the gear of the new plate cylinder be moved relative to the impression cylinder to a position which corresponds to the usual impression throw off position.

According to a preferred feature of the invention two gears are freely rotatably mounted on the two mutually opposite stub shafts of the impression cylinder and are adapted to be coupled to said impression cylinder and each of said gears is adapted to be moved into mesh with the gear of one of the two plate cylinders. In that case the gear of the plate cylinder used for the current printing job and the gear of the plate cylinder for use in the next following printing job can be caused to mesh with the gears which are rotatably mounted on respective stub shafts of the impression cylinder and in that case the gear of the plate cylinder for use in the next following printing job will be in its impression throw off position unless the printing operation is exceptionally performed with both plate cylinders, as will be explained hereinafter. For a change-over of such a printing press from one monochrome printing job to another that impression cylinder gear which is in mesh with the gear of the plate cylinder used for the current printing job is coupled to the impression cylinder and the gear which is rotatably mounted on the other stub shaft of the impression cylinder is initially freely rotatable. For a change from one printing job to the next, the gear of the plate cylinder for use in the next following printing job can now be moved to be in loose mesh with the associated impression cylinder gear in a position that corresponds to the impression throw off position and the servomotor will then be operated to accelerate the new plate cylinder and the still freely rotatable impression cylinder gear to a speed which corresponds to the synchronous velocity. When the synchronous velocity has been reached, the impression cylinder gear will be coupled to the main drive so that the two plate cylinders are now rotated at the synchronous velocity by the main drive. For a change-over from one printing job to the other, the plate cylinder used in the preceding printing job can be moved to the impression throw off position and the plate cylinder for use in the next printing job can be moved to the impression throw on position at the same time so that the change-over from one printing job to another can be effected without an interruption of the operation of the printing press and virtually without a production of waste paper.

Toothed or claw clutches may be used to couple and uncouple the two impression cylinder gears to and from the two stub shafts of the impression cylinder. Said clutches may be of any known type. It is desirable to provide clutches which are pneumatically or magnetically actuated and have an annular housing which is fixed to the frame of the press.

The two plate cylinders mounted in a printing stand may be adapted to be driven by a single servomotor. For that purpose the servomotor may be operatively connected to a shaft, which by a clutch-brake combination is adapted to be selectively coupled and uncoupled to and from a gear or gear train for driving each of the gears which are rotatably mounted on the stub shafts of the impression cylinder. In that case the clutch-brake combination is actuated by the associated control in such a manner that the clutch is engaged and the brake is lifted on the side on which an acceleration is to be effected. The clutches and brakes of the two clutch-brake combinations at the two ends of the shaft are controlled in such a manner that upon the disengagement of a clutch the associated brake will not be applied until the plate cylinder used in the previous printing job has been moved to the impression throw off position and that impression cylinder gear which has been used to drive that plate cylinder has been uncoupled from the stub shaft of the impression cylinder. While the next printing job is being performed, the plate cylinder used for the preceding printing job can be replaced by a new plate cylinder for use in the next but one printing job.

For a convenient access to the plate cylinders, they can desirably be moved to engage the impression cylinder in positions which are spaced 180 degrees apart and preferably lie in a horizontal plane.

Six printing stands of the kind described are desirably arranged one behind the other for printing in six colors and each of said printing stands is provided with two printing units having two plate cylinders for printing in one color at a given time. The servomotors associated with the plate cylinders mounted in adjacent printing stands are controlled to accelerate the associated plate cylinders approximately in phase sychronism, i.e., exactly in register, so that they rotate at the same peripheral velocity until they have reached the peripheral velocity of the impression cylinders. This is accomplished in that all servomotors are jointly controlled to rotate at the same velocity exactly in phase synchronism. That requirement will be met as the plate cylinders are running up and slowing down. This means that all plate cylinders will be installed in such angular positions that they will be in register and said relative angular position will not be changed as the plate cylinders are running up. Similarly, the plate cylinders will remain in the relative angular position in which they are in register also when they have come to a standstill.

If only one printing unit of each printing stand is used to print at a given time, it will be possible during the performance of a given printing job to set up the other printing unit of each printing stand for use in the next printing job and the next printing job can then be started virtually as soon as the current printing job has been completed and without a production of waste paper.

The printing press in accordance with the invention may be used to print only with one printing stand at a time or with use of both printing units of a printing stand. For instance, if six printing stands are provided for printing in six colors it will be possible to print in six colors with both printing units of each of three printing stands and the printing units of the three other printing stands, which are not operated at that time, can be changed over.

On the other hand it will also be possible to change over only one printing unit of each of several printing stands which are operated at the same time.

DETAILED DESCRIPTION OF THE PREFERRED EMBODIMENT

Figure 1:
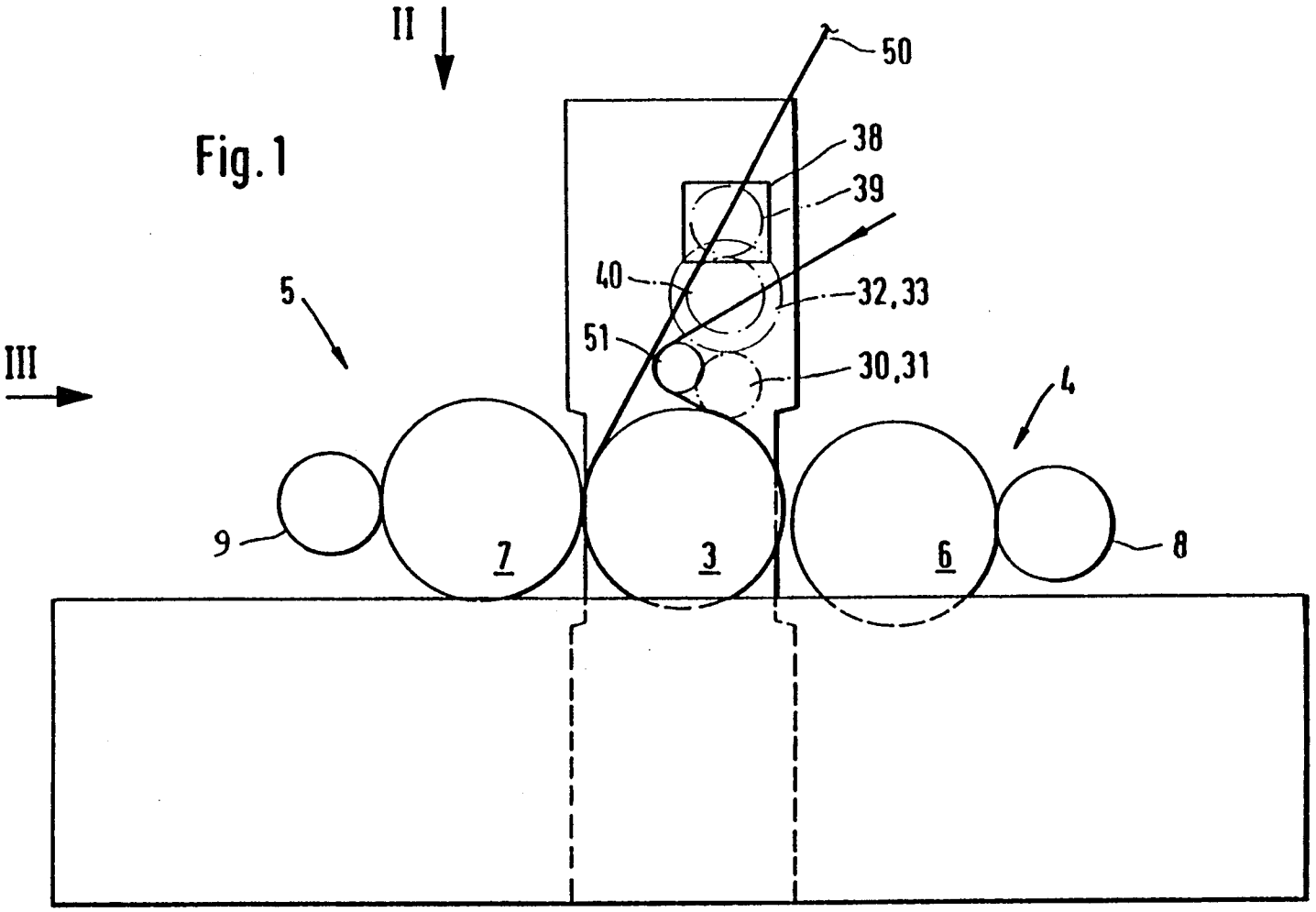
FIG. 1 is a diagrammatic side elevation showing a printing stand provided with two printing units.

An illustrative embodiment of the invention will now be described more in detail with reference to the drawing.

A printing stand comprising an impression cylinder 3 and two printing mechanisms 4, 5 is shown in the drawing. That printing stand may constitute a printing press for printing in one or two colors or may constitute a section of a multistand printing press for multicolor printing, for instance in a multicolor printing press comprising four or six printing stands. The printing stand comprises side frames 1, 2, which are interconnected by cross-beams, not shown. The impression cylinder 3 is rotatably mounted in the side frames 1, 2 in the usual manner. The plate cylinders 6, 7 of each printing unit are disposed on mutually opposite sides in positions which are spaced about 180 degrees apart in an approximately horizontal plane and are rotatably mounted in plate cylinder carriages, which are not shown and which are slidably mounted in tracks provided in the printing stands. Screw drives are provided for actuating said carriages so that they move the plate cylinders into and out of engagement with the impression cylinder 3.

An additional carriage is slidably mounted on each plate cylinder carriage and is provided with a rotatably mounted inking roller 8 or 9 which is movable by said additional carriage into and out of engagement with the plate cylinder 6 or 7. The inking mechanisms associated with said inking rollers comprise doctor blades and are of usual type and also not shown.

Figure 2:
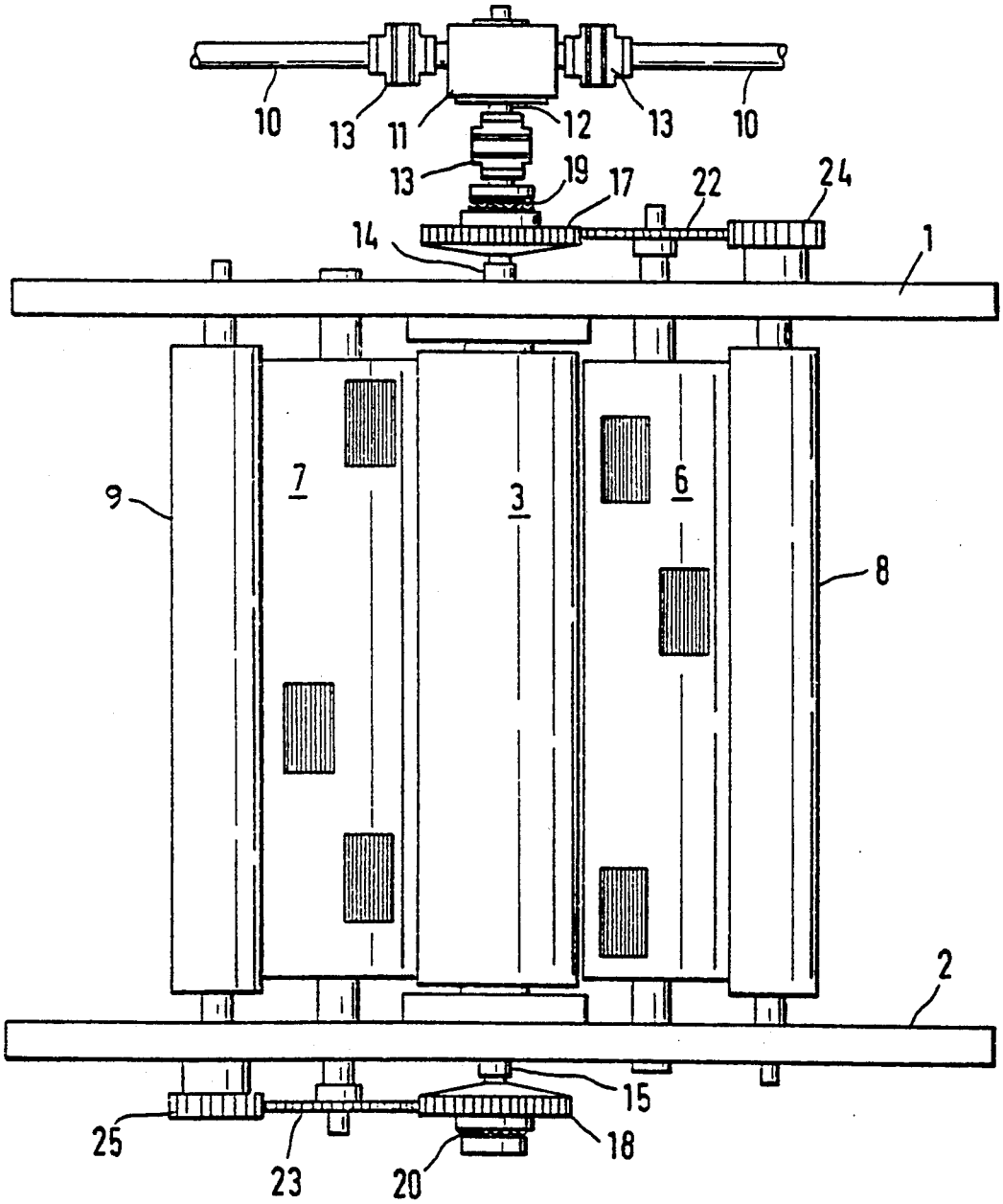
FIG. 2 is a top plan view showing the printing stand of FIG. 1 viewed in the direction of the arrows II—II in FIG. 1.
Figure 3:
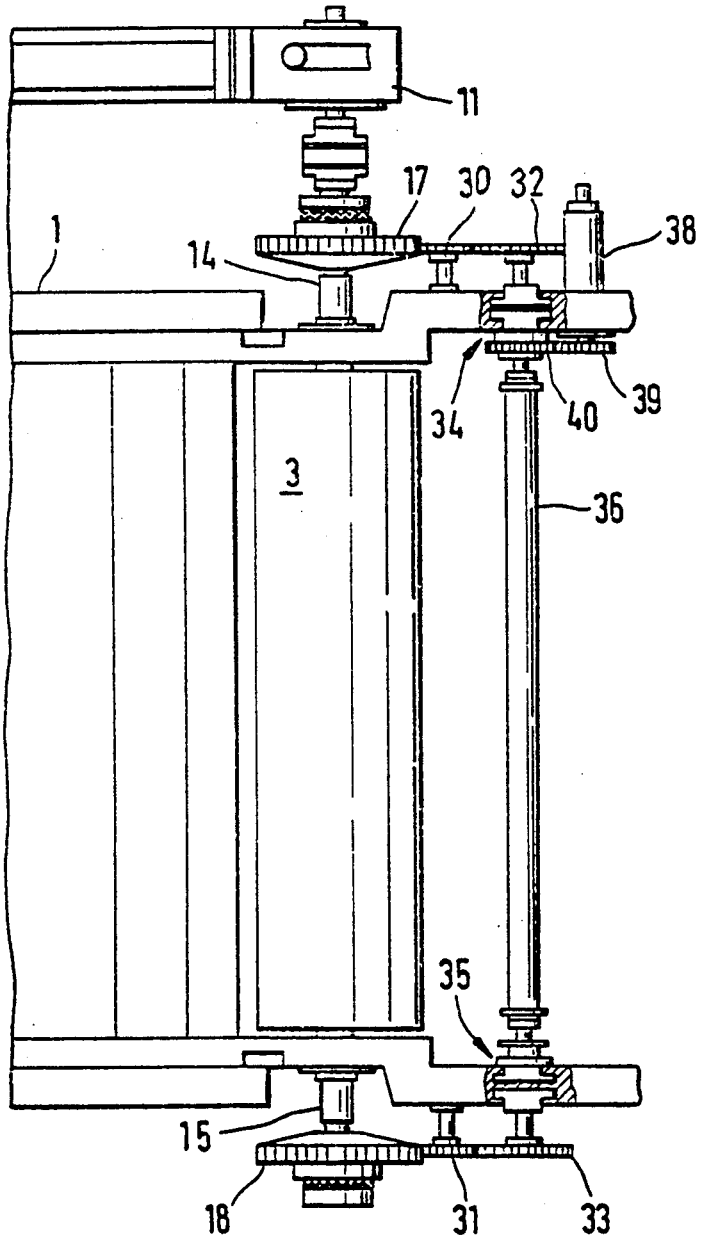
FIG. 3 is a side elevation showing the printing stand of FIG. 1 viewed in the direction of the arrows III—III in FIG. 1.

To simplify the drawing, the plate cylinder carriages and the inking roller carriages are not shown in FIG. 2, in which the plate cylinders and the inking rollers are shown to be rotatably mounted in the side frames.

The impression cylinder 3 is driven via a main drive shaft 10 and an angular worm gear train 11, which has an output shaft 12 that is coupled by a coupling 13 to the stub shaft 14 of the impression cylinder 3. That stub shaft 14 protrudes outwardly from the side frame 1 of the mounting frame. The coupling 13 is adapted to compensate lateral misalignment.

The printing stands of the printing press are arranged in a row and are operatively connected by the main drive shaft 10. The shaft sections provided between adjacent printing stands are operatively connected to input and output stub shafts of the angular worm gear trains 11 also by known couplings 13, which are adapted to compensate lateral misalignment.

Gears 17 and 18 are freely rotatably mounted on the stub shafts 14, 15 provided at opposite ends of the impression cylinder 3 and are adapted to be coupled to the stub shafts 14 and 15 by toothed clutches 19, 20. Each toothed clutch 19 or 20 is provided with an annular housing, which is not shown and by which the toothed clutch 19 or 20 can be pneumatically actuated with the aid of means which are not shown.

The plate cylinders 6 and 7 are provided at opposite ends with stub shafts, on which gears 22 and 23 are mounted, which can be caused to mesh with the gears 17 and 18 of the impression cylinder.

Gears 24, 25 provided on the inking rollers 8 and 9 similarly mesh with the gears 22 and 23 of the plate cylinders.

Idler gears 30, 31 rotatably mounted on stub shafts on the frame are constantly in mesh with the impression cylinder gears 17 and 18 and with gears 32 and 33, which are adapted to be coupled by two clutch-brake combinations 34 and 35 to a shaft 36, which is rotatably mounted in the side frames 1 and 2. The servomotor 38 is flange-connected to the side frame 1 and has an output pinion 39 that is in mesh with a gear 40, which is keyed to the shaft 36.

When the clutch-brake combinations 34 and 35 are engaged, the servomotor 38, its output pinion 39, the gear 40 and the shaft 36 can be operated to accelerate plate cylinder 6 or 7 through one of the gears 17 or 18 and the associated plate cylinder gear 22 or 23 up to the synchronous velocity. As soon as the synchronous velocity has been reached the toothed coupling 19 or 20 is actuated so that the associated gear 17 or 18, which is freely rotatably mounted on the stub shaft 14 or 15 of the impression cylinder, is coupled to the impression cylinder and is thus coupled to the main drive and plate cylinder 6 or 7 will then be driven via the main drive shaft 10. Thereafter the servomotor 38 is uncoupled from the gear 32 or 33 by disengaging the associated clutch-brake combination; said gears 32 and 33 are also freely rotatably mounted in the side frames 1 and 2, respectively, so that the gears 32 and 33 will then rotate freely in unison with the associated plate cylinders 8 and 9 as long as the latter rotates. When the brake of the corresponding clutch-brake combination 34 or 35 is applied, the associated plate cylinder will be stopped by means of the associated gear train 32-30-17 or 33-31-18.

The web 50 which is to be printed is trained around the guide roller 51 and moved in contact with the impression cylinder 3 as shown and properly moves in contact with all impression cylinders of the further printing stands. Corresponding guide rollers, not shown, are provided. In the embodiment shown by way of example the printing stand constitutes a part of a multicolor printing press and the plate cylinder 7 prints on the web 50 in one of a plurality of colors. The plate cylinder 6 has already been prepared for the next following printing job. When the current printing job has been completed, the plate cylinder 6 will be accelerated by the servomotor 38, as described above, in phase synchronism with all further plate cylinders for use in the new printing job until the plate cylinder rotates at the synchronous velocity of the web 50 which is to be printed. When the synchronous velocity has been reached, the toothed clutch 19 is actuated to couple the gear 17 to the stub shaft 14 of the impression cylinder 3 when the plate cylinder 6 and the corresponding plate cylinders of the further printing stands for use in the new printing job are in the impression throw off position. When the instruction for a change-over to another printing job is then given, the plate cylinder 7 which is still printing and the corresponding plate cylinders of all other printing stands of the printing press will be moved to the impression throw off position and all plate cylinders for the new printing job will be moved into engagement with the associated impression cylinders at the same time. The clutch-brake combinations 34 and 35 are then actuated to uncouple the servomotors and to apply the brakes for braking the plate cylinders used in the preceding printing job after the corresponding impression cylinder gears 18 have been uncoupled from the impression cylinders by the associated toothed clutches.

The means for controlling the synchronized servomotors 38 for all printing frames so that they rotate in phase synchronism are known and for this reason are not described here in detail.

We claim:

1. A printing press comprising a printing stand, an impression cylinder rotatably mounted on the stand, first and second plate cylinders rotatably mounted on the stand for selective contact with the impression cylinder, a main drive for rotating the impression cylinder, a first engageable/disengageable drive connection between the main drive and one of said plate cylinders, a second engageable/disengageable drive connection between the main drive and the other of said plate cylinders, a servo motor, a first drive train means between the servo motor and said one of the plate cylinders for accelerating the plate cylinder up to a speed synchronous with a rotation speed of the impression cylinder produced by the main drive, a first engageable/disengageable clutch means in the first drive train means, for selectively engaging and disengaging the servo motor to and from said one of the plate cylinders, a second drive train means between the servo motor and the other of said plate cylinders for accelerating the other of said plate cylinders up to the synchronous speed, and a second engageable/disengageable clutch means in the second drive train means for selectively engaging and disengaging the servo motor to and from the other of the plate cylinders whereby the respective plate cylinders are either driven from the servo motor through the respective drive train means by engagement of the respective clutch means or are driven from the main drive by engagement of the respective drive connections.

2. A printing press as defined in claim 1 wherein the first and second drive connections each comprises a stub shaft on the impression cylinder connected with the main drive, a first gear rotatably mounted on the stub shaft a second gear on a respective one of the plate cylinders meshing with the first gear, and an engageable/disengageable clutch for selectively connecting the first gear to the stub shaft.

3. A printing press as defined in claim 2 wherein the gears of the first and second drive connections are disposed at opposite ends of the cylinders respectively.

4. A printing press as defined in claim 2 wherein the first and second drive train means each comprises a gear train connected between the servo motor and a respective one of said first gears and wherein the first and second clutch devices are included in the respective gear trains.

5. A printing press as defined in claim 2 wherein the first and second clutch means each comprises a clutch/-brake configuration.

* * * * *